United States Patent [19]

Tarrant

[11] 4,009,926

[45] Mar. 1, 1977

[54] SOLDERLESS TERMINAL

[76] Inventor: Robert C. Tarrant, 2828 W. Genese St., Millington, Mich. 48746

[22] Filed: Aug. 15, 1975

[21] Appl. No.: 604,998

Related U.S. Application Data

[63] Continuation of Ser. No. 461,953, April 18, 1974, abandoned.

[52] U.S. Cl. ..... 339/276 T

[51] Int. Cl.[2] ..... H01R 11/08

[58] Field of Search ..... 339/176, 195, 196, 223, 339/275, 276, 273; 113/119

[56] References Cited

UNITED STATES PATENTS

| | | | |
|---|---|---|---|
| 375,280 | 12/1887 | Forbes | 339/223 S |
| 1,186,728 | 6/1916 | Austin | 339/276 T |
| 1,899,254 | 2/1933 | Bear | 339/223 R |
| 3,163,485 | 12/1964 | Kruitwagen et al. | 339/276 T |
| 3,168,366 | 2/1965 | Fuller | 339/273 F |
| 3,496,504 | 2/1970 | Daley | 339/223 R |

*Primary Examiner*—Joseph H. McGlynn
*Attorney, Agent, or Firm*—John J. Swartz

[57] ABSTRACT

A one piece electrical terminal including an electrically conductive, wire receiving, tubular ferrule and a male plug member comprising a tubular body, having a diameter less than the diameter of the ferrule being integral with one end of said ferrule, for insertion into a complemental receptacle.

6 Claims, 8 Drawing Figures

SOLDERLESS TERMINAL

This is a continuation of application Ser. No. 461,953, filed in the U.S. Patent Office on Apr. 18, 1974, now abandoned.

BACKGROUND OF THE INVENTION

This invention relates to an electrical terminal and more particularly to a solderless plug-type terminal which is forceably inserted into a wire gripping, springable, pressure-type receptacle member. Electrical outlets of the type disclosed in U.S. Pat. No. 2,795,677 include the conventional screw-type terminals for connecting multi-strand leads along with pressure-type screwless terminals for receiving relatively rigid one piece, non braided conductors. If one attempts to insert a stranded wire into such a pressure-type screwless terminal, the strands frequently separate and the wire bends. Although it is possible to fuse the terminal strand ends together to form a rigid conductor, this is time consuming and expensive. It is an object of the present invention to provide a solderless terminal for capping a stranded wire for connection to a pressure-type screwless receptacle.

It is another object of the present invention to provide a plug-type terminal which includes a stranded wire receiving ferrule and an integral reduced diameter male member for insertion into a pressure-type terminal receptacle.

It is yet another object of the present invention to provide a plug-type terminal including a rolled ferrule for receiving a stranded wire and an integral rolled portion integral therewith forming a plug member for insertion into a spreadable socket of an electrical device such as a switch or an outlet.

It is another object of the present invention to provide a plug-type terminal including a wire receiving ferrule portion for receiving a stranded wire and an integral hollow plug member having a circumference substantially less than the circumference of the plug member for insertion into a spreadable socket member.

It is yet another object of the present invention to provide a method of forming a solderless, plug-type terminal.

Other objects and advantages of the present invention will become apparent to those of ordinary skill in the art as the description thereof proceeds.

SUMMARY OF THE INVENTION

A terminal comprising a hollow, cylindrically shaped ferrule for receiving a multi-strand electrical conductor and an integral, smaller diameter, hollow, cylindrical shaped male plug for insertion into a complementally formed receptacle.

The present invention may more readily be understood by reference to the accompanying drawings, in which.

Figure 6:
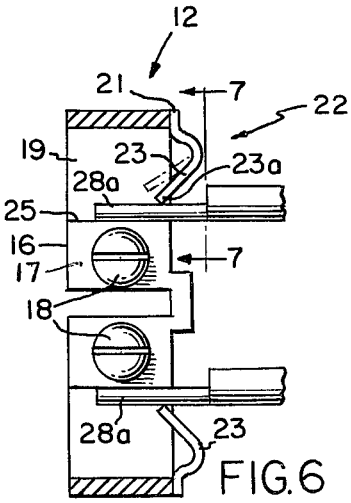
FIG. 6 is a sectional view of apparatus constructed according to the present invention received in an electrical receptacle.

A terminal constructed according to the present invention is generally designated 10 (FIG. 1) and is particularly adapted for use with an electrical device, generally designated 12, (FIG. 6) such as a switch or an outlet of the type commonly mounted in the wall of a home and more particularly described in the aforementioned patent. Generally, the receptacle 12 includes a non-metallic base or housing 14 and a metal, electrically conductive member 16 having pressure-type, screwless receptacles, generally designated 22, which are each used to releasably receive and grip a portion of the terminal 10 constructed according to the present invention. The screwless receptacle 22 includes an electrically conductive blade 21, fixed to an offset portion 19 of the conductive member 16 and to the non-metallic housing 14. The blade 21 includes a wire gripping spring member 23 which cooperates with an opposed, offset portion 25 of the electrically conducted element 16 for receiving and releasably holding a portion of the terminal 10 constructed according to the present invention. The receptacle 22 also includes a portion 17 receiving screw terminal 18 around which a multi-strand wire lead **20*a*** can be wrapped in the conventional manner.

Figure 5:
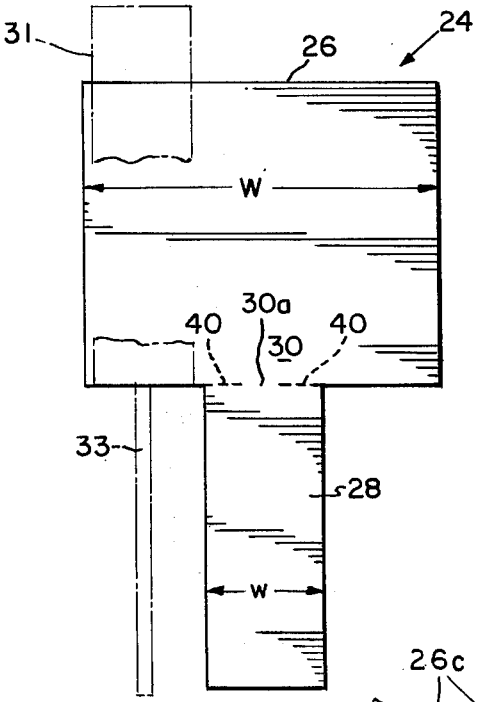
FIG. 5 is a top plan view illustrating a blank utilized to construct a terminal according to the present invention.

The terminal 10 is formed from a metal blank, generally designated 24 (FIG. 5), of electrically conductive material and may be stamped out of an integral piece of sheet metal. The blank 24 includes a base portion 26 and an integrally formed projecting portion 28 connected at one side 30 to one side of the base 26. The width *w* of the projecting 28 is substantially less than the width W of the base 26.

Figure 1:
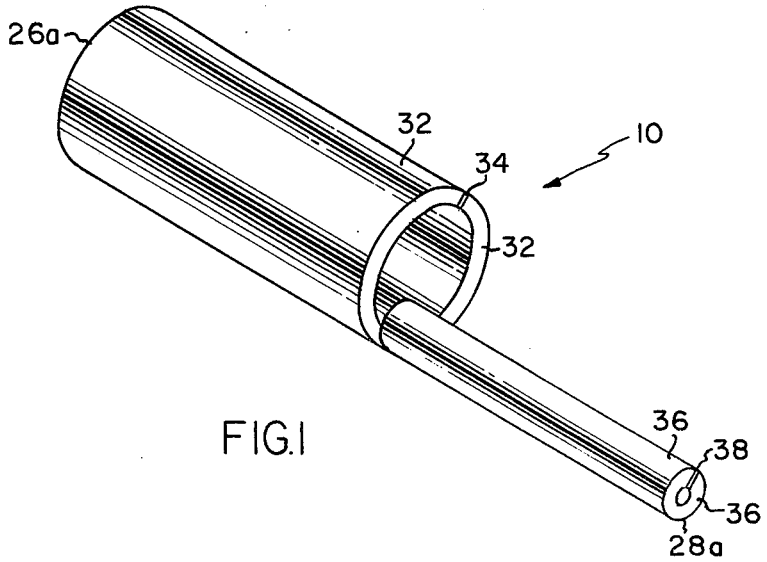
FIG. 1 is a front perspective view of a terminal constructed according to the present invention.
Figure 2:
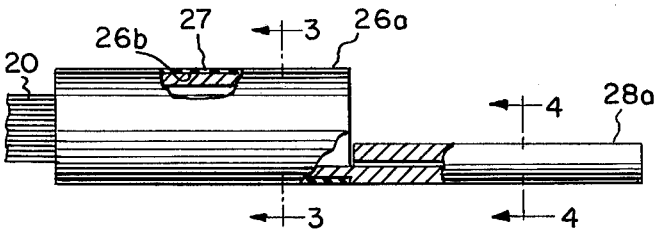
FIG. 2 is a slightly reduced, partly sectional side elevational view of a terminal constructed according to the present invention.
Figure 4:
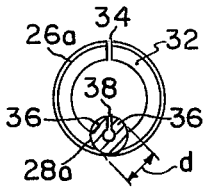
FIG. 4 is a sectional end view taken along the line 4—4 of FIG. 2.

The terminal 10 is formed by rolling the base 26 onto a mandrel, schematically designated 31, to form the cylindrical, hollow, wire receiving ferrule **26*a* (FIG. 1) having opposed portions 32 separated by a gap 34 and concurrently rolling the reduced width blank portion 28 about a reduced diameter projecting mandrel portion 33 to provide a rolled, rigid plug-type hollow cylindrical terminal 28*a* having opposed portions 36 separated from each other by a gap 38. As illustrated in FIGS. 1, 2 and 4, the plug type terminal 28*a* is provided with an axial passage therethrough. The diameter of the passage is substantially less than the diameter of the hollow, cylindrical terminal 28*a*. The ferrule 26*a* has an internal diameter of such size as to freely receive the terminal end of a multi-strand electrical, wire lead 20. Prior to rolling the blank portion 24, opposite sides of the blank portion 30, joining the blank portion 26 and the projecting blank portion 28, are severed to provide slits as illustrated at 40, on opposite sides of a central junction portion 30*a*. The slits 40 permit the distal free ends of 32 and 36** to be rolled to different diameters.

Figure 3:
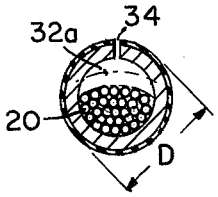
FIG. 3 is a sectional end view taken along the line 3—3 of FIG. 2.

At the jobsite, the workman slides the ferrule **26*a* over the terminal end of a multi-strand wire and then crimps the ferrule 26*a* with a hand tool to insure that it tightly grips the stranded wire 20 as illustrated in chain lines at 32*a* (FIG. 3). The cylindrical, plug-type terminal end 28***a* may be easily and quickly fed between the springable blade 23 and the offset opposed base portion 25. The edge 23*a* of the springable blade 23 releasably grips the plug-type terminal end 28*a*. In order to remove the terminal 10, the blade 23 must be forced upwardly from the position illustrated in FIG. 6 to the position illustrated in chain lines in FIG. 6.

The terminal 10 may be sprayed with, or dipped in a bath of, insulating material 27 before or after being crimped to the stranded wire 20. If it is sprayed or dipped before being crimped to the wire 20, the exterior surface 26*b* of the wire receiving ferrule 26*a* must be blanked. As illustrated in FIGS. 3 and 4, the diameter *d* of the terminal portion 28*a* is substantially less than the diameter D of the ferrule 26*a*.

Figure 8:
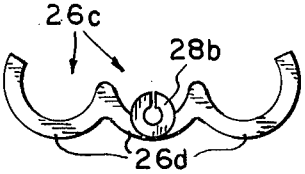
FIG. 8 is an ene elevational view similar to FIG. 4 illustrating a slightly modified construction.
Figure 7:
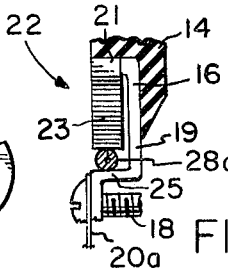
FIG. 7 is a sectional view taken along the line 7—7 of FIG. 6.

The embodiment illustrated in FIG. 8 is similar to the embodiment illustrated in FIGS. 1 –7 except that the wire receiving ferrule portion 26*c* is substantially larger than the wire receiving ferrule portion 26*a* and includes three lobes 26*d* to receive three multi-strand wires 20. The plug-type terminal 28*b* is identical to the male plug-type terminal 28*a*.

The wire terminal 10 is formed by placing the blank 24 in juxtaposition with the mandrel 31 and wrapping the blank 24 about the mandrel so that the base portion 26 is wrapped around the base mandrel portion 31 and the projecting portion 28 is wrapped around the projecting mandrel portion 33. The terminal is removed from the mandrel 31 and 33 and moved to a jobsite where a workman slides a multi-strand wire 20 into the cylindrical ferrule portion 26*a*. The ferrule portion 26*a* is crimped onto the multi-strand wire 20, as illustrated at 32*a* in FIG. 3, to tightly grip the wire 20. The cylindrical portion 28*a* is rigid in comparison to the flexible strands 20 and may be easily fed into the receptacle 12 between the shoulder 25 and the springable blade 23 to spread the blade to the position illustrated in FIG. 6. The electrical circuit is thus completed to the outlet 12.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An electrical terminal comprising:

electrically conductive, conductor receiving crimpable cylindrical ferrule means, being of predetermined perimetrical length, and having a pair of opposed free edge portions in confronting relation with each other; and male plug means for insertion into a complemental electrical receptacle, said plug means including an intermediate portion integral with a portion of said ferrule means interjacent said free edge portions, said male plug means including distal edge portions in confronting relation with each other and separated from said free edge portions by gaps on opposite sides of said intermediate portion to permit the free edge portions and distal edge portions to be freely and independently rolled into said confronting relation, the perimetrical length of said plug means being substantially less than the perimetrical length of said cylindrical ferrule means;

said male plug means comprising an additional hollow cylinder having a diameter substantially less than the diameter of said cylindrical ferrule means; said cylinder having an axial passage therethrough, the diameter of said passage being substantially less than the external diameter of said cylinder.

2. The terminal as set forth in claim 1 wherein said ferrule means is a rolled sheet of metal having distal, separated ends, said male plug means comprises a smaller diameter, rolled sheet of metal having a midportion integrally connected at one side to one side of the midportion of said first mentioned cylinder means and having distal separated ends which are diametrically opposite said one side.

3. The terminal a set forth in claim 1 wherein said ferrule means comprises a plurality of generally parallel, curvilinear lobes disposed between said pair of free edge portions for receiving a plurality of electrical conductors, said lobes including longitudinal side portions integrally connected at least in part to the side portions of an adjacent lobe.

4. In combination:

a female receptacle including blade means yieldable in response to pressure to receive and grip a complemental male plug; and an electrical terminal comprising:

a hollow, cylindrically shaped, electrically conductive ferrule portion for receiving an electrical conductor, and a smaller, substantially uniform diameter, hollow, cylindrically shaped, electrically conductive, male plug having a diameter substantially smaller than the diameter of said ferrule portion and including a portion integral with said ferrule portion, said male plug being removably insertable into said electrical receptacle, said plug having an axial passage therethrough, the diameter of said passage being substantially less than the diameter of said male plug.

5. A method of making a terminal comprising the steps of:

rolling a first portion of an electrically conductive blank about a mandrel means to provide a crimpable, wire receiving, cylindrical ferrule, having a first axial passage therethrough;

concurrently rolling a second portion of said electrically conductive blank, having a portion integral with said first portion, about a reduced diameter mandrel portion to provide a rigid, hollow male plug having a substantially uniform diameter substantially less than the diameter of said ferrule for insertion into a female receptacle, said second portion having a second axial passage therethrough; and axially relatively moving said first and second portions and said mandrels to remove said first and second portions from said first and second axial passages, the diameter of said second passage being substantially less than the diameter of said male plug.

6. The method set forth in claim 5 wherein said method includes the preliminary step of providing slits in opposite sides of said blank to an intermediate blank portion joining said first and second portions but separating said first and second portions on opposite sides of said intermediate portion so that said first and second portions on opposite sides of said intermediate portion can be freely and independently rolled.

* * * * *